United States Patent [19]

Landau

[11] Patent Number: 4,632,244

[45] Date of Patent: Dec. 30, 1986

[54] MULTIPLE CHAMBER FLEXIBLE CONTAINER

[76] Inventor: Boris Landau, 20121 Imperial Cove La., Huntington Beach, Calif. 92646

[21] Appl. No.: 831,718

[22] Filed: Feb. 19, 1986

[51] Int. Cl.[4] ..... B65D 25/08; B65D 27/08

[52] U.S. Cl. ..... 206/219; 206/220; 206/221; 383/3; 53/403; 53/469; 53/474; 366/130

[58] Field of Search ..... 206/219, 220, 221, 568; 383/38, 3; 53/140, 403, 469, 474; 366/129, 130, 69, 349

[56] References Cited

U.S. PATENT DOCUMENTS

| | | | |
|---|---|---|---|
| 2,932,385 | 4/1960 | Bollmeier et al. | 206/219 |
| 2,978,119 | 4/1961 | Cushman | 383/3 |
| 3,175,558 | 3/1965 | Caillouette et al. | 128/403 |
| 3,290,017 | 12/1966 | Davies et al. | 206/220 |
| 3,294,227 | 12/1966 | Schneider et al. | 206/219 |
| 3,351,058 | 11/1967 | Webb | 206/219 |
| 3,429,429 | 2/1969 | Poitras | 206/222 |
| 3,462,070 | 8/1969 | Corella | 206/219 |
| 3,608,709 | 9/1971 | Pike | 206/219 |
| 3,744,625 | 7/1973 | Chin | 206/219 |
| 3,756,389 | 9/1973 | Firth | 206/219 |
| 3,891,138 | 6/1975 | Glas | 206/219 |
| 3,950,158 | 4/1976 | Gossett | 62/4 |
| 3,964,604 | 6/1976 | Prenntzell | 206/219 |
| 3,983,994 | 10/1976 | Wyslotsky | 206/219 |
| 4,000,996 | 1/1977 | Jordan | 62/4 |
| 4,183,441 | 1/1980 | Erlandson | 206/430 |
| 4,226,330 | 10/1980 | Butler | 206/620 |
| 4,227,614 | 10/1980 | Hollander, Jr. | 206/459 |
| 4,402,402 | 9/1983 | Pike | 206/219 |
| 4,458,811 | 7/1984 | Wilkinson | 206/219 |
| 4,465,488 | 8/1984 | Richmond et al. | 604/414 |
| 4,516,949 | 5/1985 | Schwartz | 53/403 |
| 4,519,499 | 5/1985 | Stone et al. | 206/219 |

*Primary Examiner*—William Price
*Assistant Examiner*—Brenda J. Ehrhardt
*Attorney, Agent, or Firm*—Klein & Szekeres

[57] ABSTRACT

A flexible container comprises a receptacle divided into two chambers by an openable, fluid-tight barrier formed between the interior surface of the receptacle and the exterior surface of a hollow member contained in the receptacle. The barrier is maintained closed by a removable sealing band applied around the exterior of the receptacle. The removal of the band allows the wall surface of the receptacle to separate from the exterior surface of the hollow member, thereby opening a passage between the two chambers. The container is manufactured by a process comprising the steps of: (a) providing a tube of resiliently-deformable material; (b) sealing a first end of the tube; (c) expanding the tube to a desired shape; (d) partially filling the expanded tube with a first material; (e) inserting an uninflated balloon into the expanded tube; (f) inflating the balloon so that its exterior surface is spaced from, and proximate to, the interior surface of the tube; (g) applying the sealing band around the exterior surface, of the tube with sufficient tightness to sealingly close the space between the balloon and the tube; (h) filling at least part of the tube between the balloon and the second tube end with a second material; and (i) sealing the second tube end.

20 Claims, 17 Drawing Figures

MULTIPLE CHAMBER FLEXIBLE CONTAINER

BACKGROUND OF THE INVENTION

This invention relates generally to the field of flexible containers or bags of the type commonly used in the medical field for storing materials to be delivered to a patient intravenously or parenterally. More particularly, it relates to such a container which is divided into two or more compartments or chambers, each holding a different material, wherein the compartments are separated by a removable barrier, so that the contents of the compartments can be allowed to intermix prior to administration to the patient.

In the medical field, it is often necessary, when administering intravenous medication or parenteral nutrition, to combine two or more materials which must be stored separately. For example, parenteral nutrition frequently makes use of a solution of dextrose and amino acids. Such a solution cannot remain stable for extended periods of time; hence separate storage of the dextrose and the amino acids is necessary. Also, certain drugs that are administered intravenously can only be stored in a dry, powdered form, and must therefore be dissolved in a liquid diluent prior to administration.

While the two (or occasionally more) components of the intravenous or parenteral solution must be separately stored, it is obviously necessary to provide for a quick and convenient mixing of the components in a closed, sterile system just prior to administration. To this end, flexible containers have been devised, in various configurations, with multiple chambers or compartments separated from each other by selectively rupturable or frangible seals or barriers. For example, U.S. Pat. Nos. 4,519,499; 4,465,488; and 4,458,811 disclose multi-chambered containers for medical applications, wherein the chambers are separated by a frangible barrier. Other containers having a frangible or rupturable barrier between two or more compartments are disclosed in the following U.S. Pat. Nos.: 3,175,558; 3,294,227; 3,429,429; 3,462,070; 3,608,709; 3,744,625; 3,756,389; 3,891,138; 3,964,604; 3,950,158; 3,983,994; 4,000,996; 4,226,330; 4,227,614; and 4,402,402.

Prior art containers which utilize a rupturable barrier or seal have several drawbacks. Specifically, in many prior art devices, the action of mechanically breaking or rupturing the barrier or seal must be undertaken with a great deal of care, lest damage result to the container itself. In addition, in some prior art containers of this type, there is a possibility of some fragmentation of the barrier or seal. While in many applications such fragmentation might not present any significant problem, in some applications, such as intravenous infusion, the danger of injury to the patient may be present. As a result, many practitioners in the medical field find the prior art multi-chamber containers difficult or inconvenient to use.

In most, if not all, of the frangible-barrier devices, the strength of the seal or barrier, and therefore the force needed to break it, depend, in substantial part, upon the physical characteristics of the material forming the barrier. Thus, to assure uniformity in the strength of the seal or barrier, its physical specifications must be precisely controlled, thereby adding to the cost of such containers. Moreover, the relatively complex structure of such frangible seals and barriers also adds to the cost of manufacture. Such relative complexity, however, was felt to be unavoidable due to the need to provide good seal integrity while minimizing the chances of inadvertent rupture.

Thus, there has been a long-felt, but as yet unsatisfied, need for a multi-chamber container in which the chambers remain isolated from each other until the mixing of their respective contents is desired, and yet which provides this function with a sealing mechanism that is both economical to manufacture and easy to use without undue concern about either inadvertent inter-chamber leakage or damage to the container itself.

SUMMARY OF THE INVENTION

Broadly, the present invention is a flexible container comprising an elongate, close-ended flexible receptacle divided into two compartments by an openable, fluid-tight barrier formed between the exterior surface of a hollow member contained in the receptacle and the interior wall surface of the receptacle itself, wherein the barrier is closed by removable sealing means applied around the exterior of the receptacle. The removal of the sealing means allows the wall surface of the receptacle to separate from the exterior surface of the hollow member, thereby opening a passage therebetween which allows communication between the two compartments and the intermixing of their respective contents.

In a specific preferred embodiment of the invention, the hollow member is an inflated balloon or bubble of resilient plastic material, and the sealing means includes a strip or band of flexible material that is removably applied or wrapped around the exterior of the receptacle so as to bring the interior wall surface of the receptacle into sealing engagement with the exterior surface of the balloon. This sealing engagement thus divides the receptacle into two fluid-tight compartments or chambers, one on each side of the balloon. The material in each compartment is thereby isolated from the material in the other compartment until the sealing strip or band is removed to open the passage communicating between the two chambers.

A unique advantage of this invention is the lack of any structural or sealing member that is ruptured or broken inside the container. In fact, the seal or barrier between the two chambers is opened by simply peeling the sealing strip off of the receptacle, so that there is no rupturing or breaking apart of any element of the device. Thus, the above-described disadvantages associated with prior art devices having breakable or rupturable seals or barriers are not associated with the present invention. In addition, good seal integrity is maintained with the present invention, while minimizing chances of leakage between the chambers due to accidental breakage of the seal or barrier. Moreover, these advantages are achieved with a structure that is both economical to manufacture and simple to use.

Another aspect of the invention is the novel method of manufacturing the above-described container. Briefly, the method comprises the steps of (a) providing a tube of resiliently-deformable material (e.g., a suitable thermoplastic); (b) sealing one end of the tube; (c) expanding the tube to a predetermined shape; (d) partially filling the expanded tube with a first material (e.g. a diluent) so that the first material is contained near the sealed end; (e) inserting an uninflated balloon into the tube through the other (open) end; (f) inflating the balloon so that the exterior surface of the balloon is spaced from, and proximate to, the interior surface of the tube so as to define a circumferential passage therebetween; (g) applying a removable sealing member around the exterior surface of the tube with sufficient tightness to close the passage; (h) filling at least part of the tube between the balloon and the open end with a second material (e.g., a powdered medication); and (i) sealing the second end of the tube.

This method can be implemented on a mass production basis, and requires little in the way of precision machining (other than, possibly, the molds in which the tubes are expanded and formed). In addition, the method allows a precise metering of the materials with which the container is filled. The result is a highly-efficient, economically-implemented manufacturing method.

The above-described advantages of the present invention, as well as other advantages, will be more fully appreciated from the detailed description which follows.

DETAILED DESCRIPTION OF THE INVENTION

Figure 1:
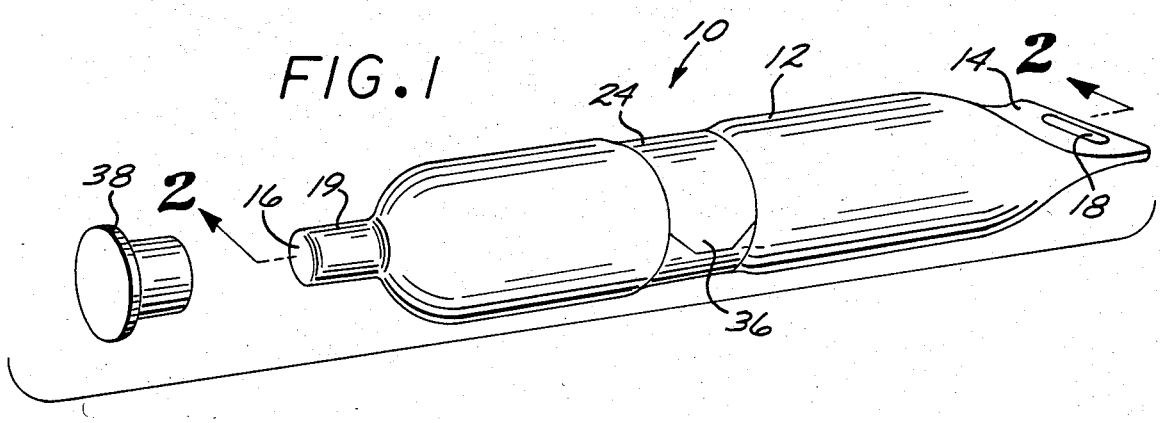
FIG. 1 is a perspective view of a flexible, multi-chamber container in accordance with a preferred embodiment of the present invention.

1. The Container of FIGS. 1 through 5

FIGS. 1 through 5 illustrate a preferred embodiment of a flexible, multi-chamber container 10 constructed in accordance with the present invention. The container 10 comprises an elongate tubular receptacle 12 having a sealed distal end 14 and a sealed or closed proximal end 16. The receptacle 12 is made of a resiliently-deformable plastic material, preferably a thermoplastic elastomer, selected for hydrolytic stability and biological inertness. One such material is a polyurethane marketed by the Upjohn Company under the trademark PELLETHANE 2363. Another suitable material is a styrene ethylene-butylene styrene modified block copolymer marketed under the trademark C-FLEX TPE by Concept Polymer Technologies, Inc., of Clearwater, Fla. Alternatively, polyvinyl chloride or polyethylene materials may be suitable. Typical physical characteristics for the material may advantageously be derived from the following table:

TABLE 1

| Characteristics | Units | ASTM Method |
|---|---|---|
| Durometer Hardness | 50 ± 5 Shore A | D-2240 |

TABLE 1-continued

| Characteristics | Units | ASTM Method |
|---|---|---|
| Tensile Strength | 1400 ± 200 PSI at 23° C. | D-412 |
| Tensile Modulus | 300 ± 50 PSI at 300% | D-412 |
| Elongation | 800% ± 100% at Break at 23° C. | D-412 |
| Tear Strength (Method-Die C) | 160 ± 30 lbs/in. | D-624 |

The distal end 14 of the receptacle 12 is preferably sealed along a flattened seam with an aperture 18 provided therein, for purposes to be described below. The proximal end 16 is formed into a reduced diameter nipple 19, as shown. The entire receptacle 12 is preferably of a unitary seamless (except for the distal end seam) construction, as will be described in connection with the detailed description of the manufacturing method which follows.

Figure 2:
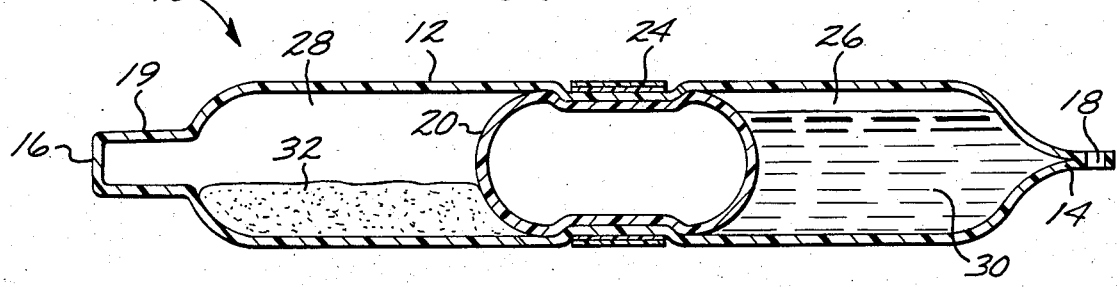
FIG. 2 is a cross-sectional view along line 2—2 of FIG. 1.
Figure 5:
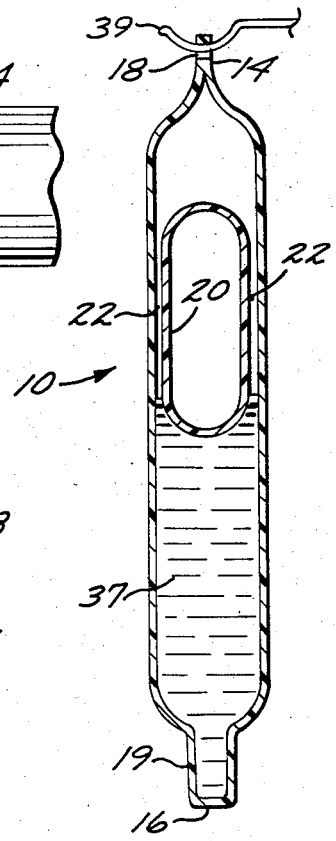
FIG. 5 is a cross-sectional view similar to that of FIG. 4, but showing the container disposed vertically.
Figure 4:
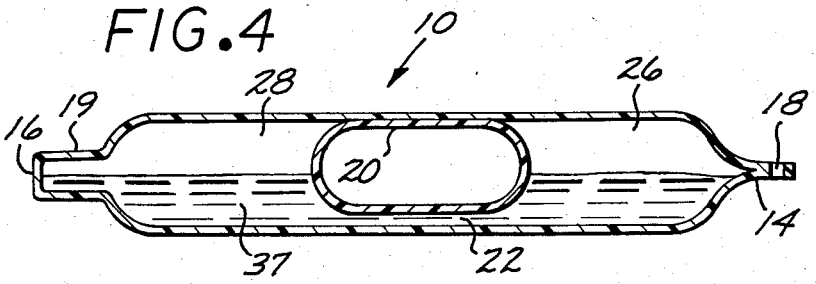
FIG. 4 is a cross-sectional view showing the container disposed horizontally after the sealing strip has been removed.

As shown in FIGS. 2, 4, and 5, disposed in the interior of the receptacle 12 is a hollow bubble or balloon 20. The balloon 20 may be made of a similar material to that of the receptacle 12, and it is inflated with air, as will be described below. As best shown in FIG. 4, the balloon 20 has an inflated circumference that is slightly smaller than the internal circumference of the receptacle 12, so that the exterior surface of the balloon 20 is spaced from, and proximate to, the interior surface of the receptacle. Thus, a substantially circumferential passage 22 (FIG. 4) is defined between the exterior surface of the balloon 20 and the interior surface of the receptacle 12.

Figure 3:
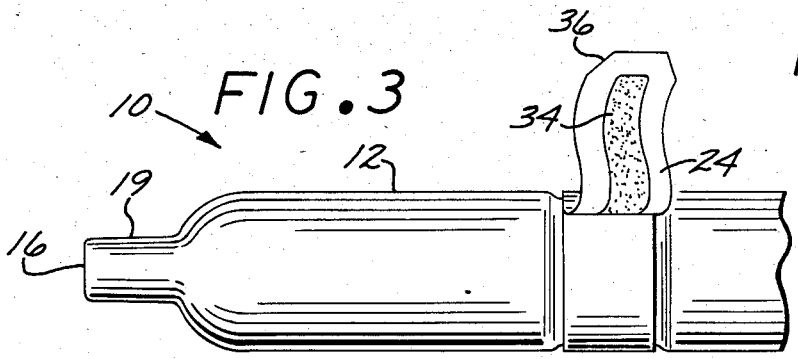
FIG. 3 is a fragmentary elevational view of the container of FIG. 1, showing the sealing strip in the process of being removed.

The passage 22, best shown in FIG. 4, is selectively openable by means of a removable sealing band or strip 24, best shown in FIGS. 2 and 3. The sealing strip 24 is made of a flexible material, such as, for example, a plastic strip or a cellulose "shrink-fit" band. The strip or band 24 is applied around the exterior surface of the receptacle 12 with sufficient tightness to create a fluid-tight barrier or seal between the exterior surface of the balloon 20 and the interior surface of the receptacle 12. This seal or barrier created by intimate surface-to-surface contact between the receptacle 12 and the balloon 20 effectively divides the interior of the receptacle into two fluid-tight compartments or chambers: a first, or distal, chamber 26, and a second, or proximal, chamber 28. Thus, as shown in FIG. 2, a first material 30 can be contained in the distal chamber 26, and a second material 32 can be separately contained in the proximal chamber 28 without leakage of one material into the other. The first material, for example, may be a liquid diluent in which the second material, in particulate or powdered form, is soluble. Alternatively, both materials can be liquids which are mixable with each other.

If the sealing strip 24 is a plastic band, it can advantageously be held in place by a layer of adhesive 34 (FIG. 3), with an end tab 36 that can be grasped to unwrap the strip 24 from the receptacle 12. A similar tab can be provided on a shrink-fit cellulose band, as is well-known in the art. When the strip 24 is peeled or unwrapped, the resiliency of the receptacle cause it to spring back to its original shape, as shown in FIG. 4, thereby separating the interior surface of the receptacle 12 from the exterior surface of the balloon to open the passage 22. The open passage 22, in turn, provides communication between the distal chamber 26 and the proximal chamber 28, thereby allowing the contents of the two chambers to intermix, as indicated by the numeral 37 in FIGS. 4 and 5.

The container 10 is stored with the sealing strip in place to maintain a fluid-tight barrier between the two chambers, thereby isolating their respective contents from one another. A protective end cap 38 (FIG. 1) may be provided to fit over the nipple 19, thereby to protect the nipple from inadvertent rupturing. When it is desired to dispense the container's contents, the sealing strip 24 is removed to open the passage 22, as described above. The end cap 38 is removed, and an appropriate conduit (not shown) may be inserted into the nipple 19. To facilitate the mixing of the two materials, the container 10 may be agitated. In most applications, such as intravenous or parenteral infusion, the container 10 may be suspended from a support stand (not shown) with the distal end 14 uppermost and the proximal end 16 hanging downwardly, as shown in FIG. 5. To this end, the aperture 18 in the distal end 14 is provided, so that a hook 39 or the like on the support stand may be inserted therein. When the container 10 is thus inverted, the balloon 20 floats upwardly toward the distal end 14, thereby occupying the portion of the receptacle formerly comprising the distal chamber 26. This action diminishes the volume of the distal chamber 26 while expanding, distally, the volume of the proximal chamber 28, so that the contents of the distal chamber are displaced proximally into the proximal chamber, thereby enhancing the intermixing of the two materials. Furthermore, the balloon 20 floats upwardly away from the container outlet in the nipple 19, leaving an unobstructed path for the gravity flow of the mixture from the container. In addition, the balloon 20 tends to keep the wall of the receptacle 12 from collapsing on itself as the container empties, thereby further aiding the free flow of the contents therefrom.

2. The Method of Manufacture (FIGS. 5–16)

FIGS. 6 through 17 illustrate the steps of a method of manufacturing the container shown in FIGS. 1 through 5.

Figure 6:
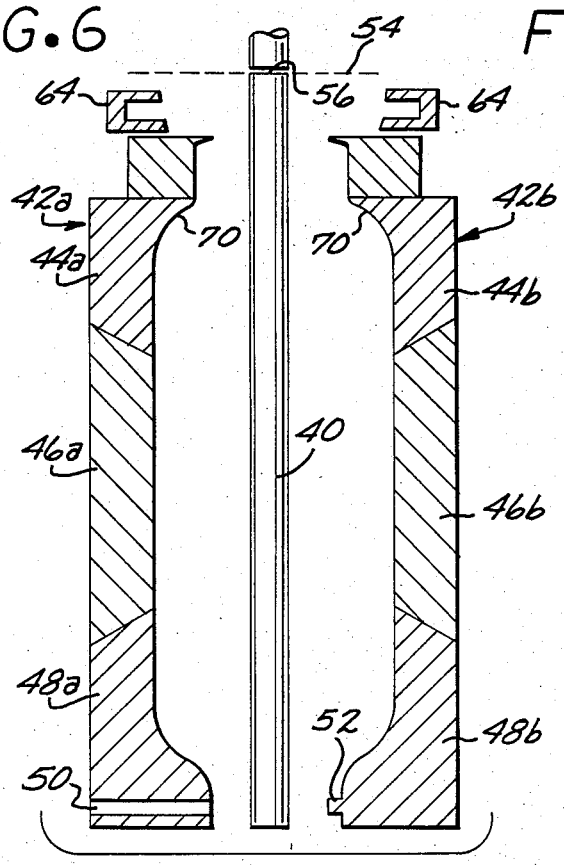
FIGS. 6 through 16 are idealized, semi-diagrammatic views illustrating the steps in the method of manufacturing the container of FIGS. 1 through 4, showing a molding, sealing, and filling apparatus used in the method.

As shown in FIG. 6, the manufacturing process begins by providing a tube 40 formed from one of the above-described thermoplastic materials. The tube 40 (which is to become the receptacle 12) may be continuously extruded into the interior of an axially-segmented mold, which is divided into two opposed radial mold halves **42*a* and 42*b*. The mold half 42*a* is divided into three axial segments: an upper segment 44*a*, a middle segment 46*a*, and a lower segment 48*a*. Likewise, the mold half 42*b* is similarly divided into an upper segment 44*b*, a middle segment 46*b*, and a lower segment 48*b*. The lower segment 48*a* has a horizontal slot 50 which is dimensioned to receive a projection 52 extending inwardly from the opposed lower segment 48*b*. The middle segments 46*a* and 46*b* are separately removable from the mold halves 42*a* and 42*b***, as will be explained below.

Figure 7:
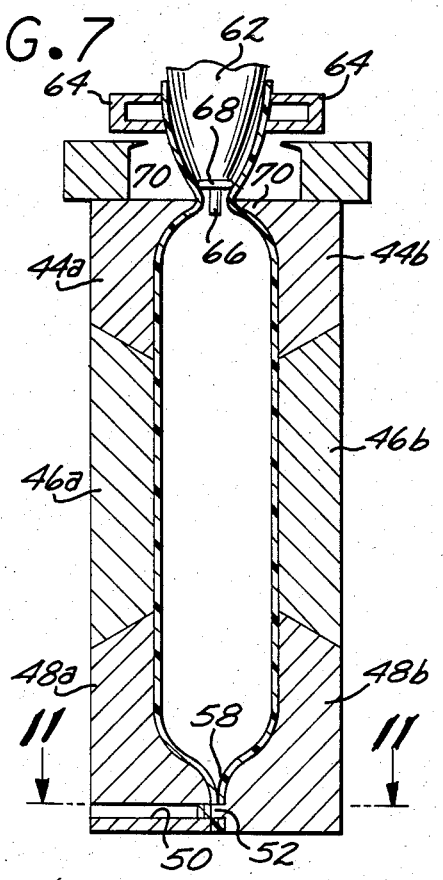

When the tube 40 is extruded to the desired length into the mold, it is cut (by conventional means, not shown) where indicated by the dashed line 54 in FIG. 6, thereby forming an open proximal end 56 of the tube 40. The mold halves are closed, bringing the lower mold segments into contact with each other to close the distal end of the tube 40 along a fluid-tight seal or seam 58, as shown in FIG. 7.

Figure 11:
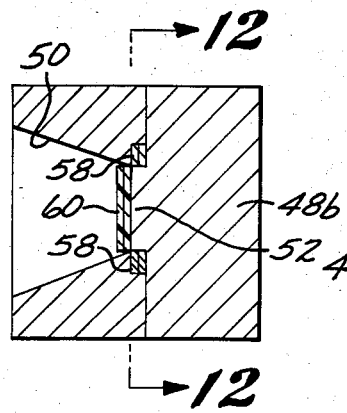
Figure 12:
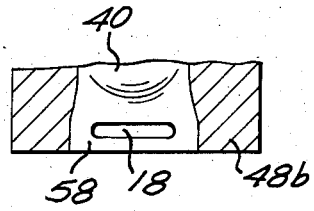

As best shown in FIGS. 11 and 12, when the mold halves **42*a* and 42*b* are brought together, the projection 52 on the lower mold segment 48*b* acts as a die or a punch, cutting a scrap section 60 out of the seam 58 to form the aperture 18 described above with respect to the discussion of FIGS. 1 through 5. As can be seen in FIG. 11, the slot 50 is outwardly tapered to facilitate removal of accumulated scrap sections 60**.

Turning once again to FIG. 7, after the mold halves **42*a* and 42*b* have closed, the mold is stationed under an air nozzle 62 which is inserted into the open proximal end 56 of the tube 40. As the nozzle 62 is inserted, a retaining collar 64 movably mounted on top of the mold is moved radially inwardly to provide stability. The nozzle 62 is tapered to allow insertion through the proximal tube end 56, so that the nozzle's tip 66 is surrounded by the upper portions of the upper mold segments 44*a* and 44*b*. The nozzle 62 has a sealing flange 68 near the tip 66**.

The wall of the tube 40 is captured between the flange 68 and a peripheral neck 70 extending radially inwardly from the upper mold segments **44*a* and 44*b*, thereby forming an air-tight seal. With the nozzle 62 thus seated, filtered, compressed air is blown through the nozzle 62 into the tube 40. Since the thermoplastic material of the tube is still warm and, therefore, moldable, the blown air expands the tube outwardly against interior walls of the mold until the tube assumes the configuration of the mold surface. The tube 40 then acquires the desired shape of the previously-described receptacle 12**.

Figure 8:
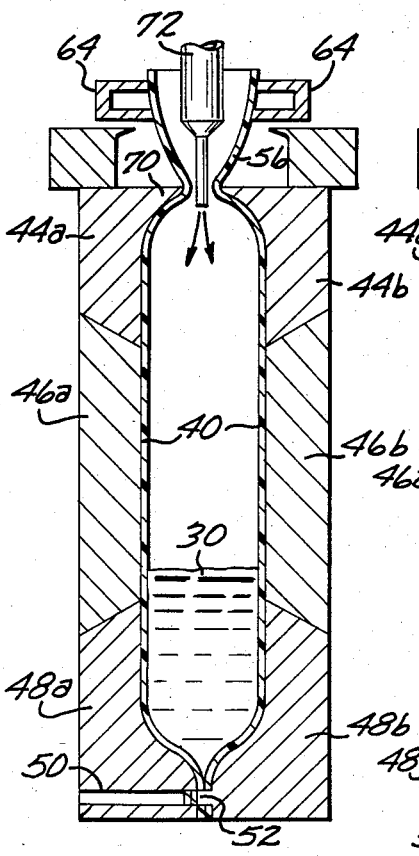

The air nozzle 62 is then withdrawn, and the air vented from the tube. The expanded tube is allowed to cool so that its configuration is fixed as the thermoplastic material sets. The expanded tube 40, still in the mold, is then stationed under a first metering nozzle 72, which is inserted into the open proximal end of the tube 40, as shown in FIG. 8. The closed distal or bottom end of the tube 40 is filled from the first metering nozzle 72 with a pre-measured amount of the first material 30, of a type previously described. The first material 30 fills only part (on the order of 25 percent to 35 percent) of the volume of the tube 40.

Figure 9:
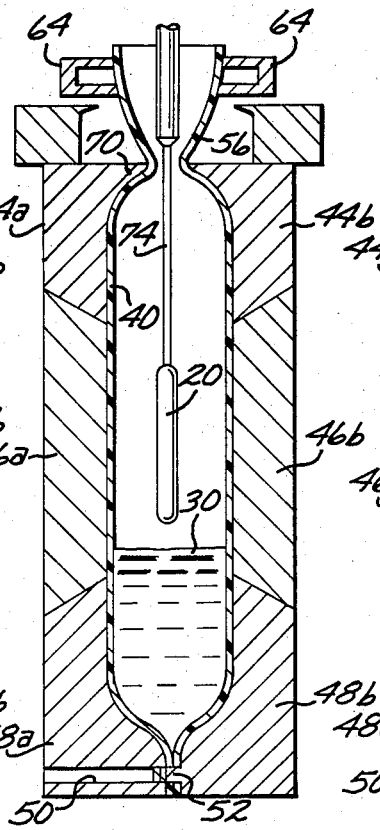
Figure 10:
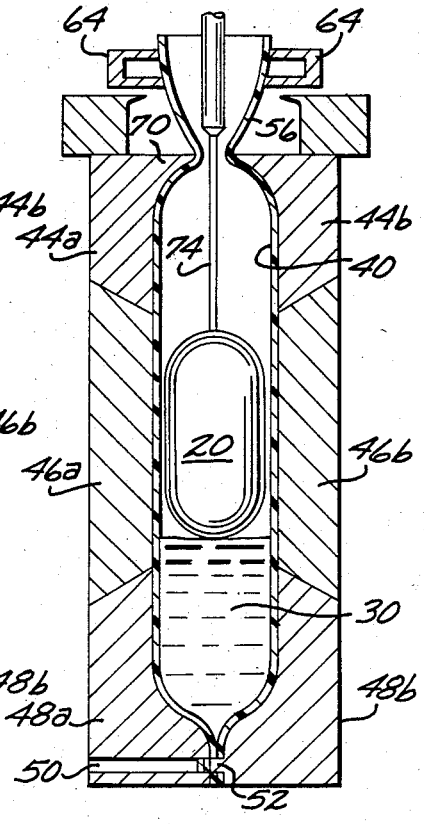

The metering nozzle 72 is then withdrawn, and the mold with the partially-filled tube is stationed at a balloon-insertion mechanism, as shown in FIGS. 9 and 10. At this station, an uninflated balloon 20, disposed at the of a hollow inflation conduit or needle 74, is inserted into the tube 40 through the open proximal end. The balloon 20 is made of a thermoplastic material, such as one of the materials mentioned above. Advantageously, the balloon is made of a material similar to that of the tube 40. At this stage, the balloon 20 is sufficiently warm to be inflated by air injected through the needle 74 until its predetermined volume is attained, as shown in FIG. 10. The predetermined volume of the balloon 20 is such that its external circumference is somewhat less than the internal circumference of the tube 40, as previously discussed in connection with the description of the container of FIGS. 1 through 5. Thus, as previously discussed, the exterior surface of the balloon 20 and the interior surface of the tube 40 form the above-described circumferential passage 22 therebetween. When the balloon 20 has been thus inflated, the needle 74 is withdrawn, and the material of the balloon, still being warm, seals itself around the hole left by the needle 74 before any significant deflation of the balloon takes place.

Figure 13:
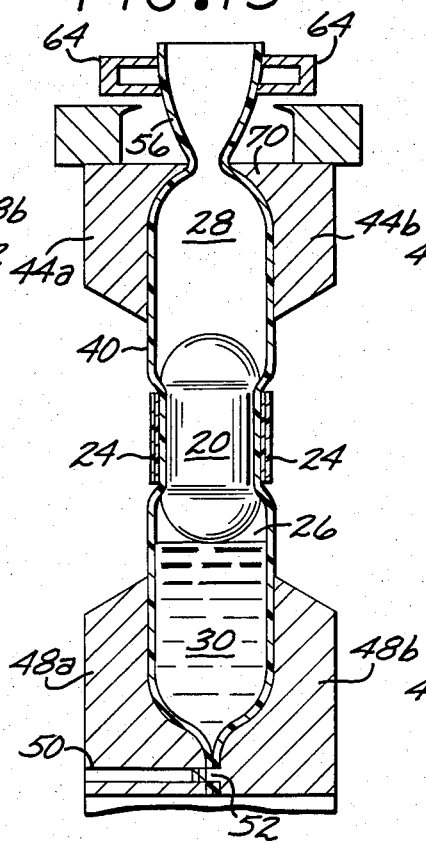

Next, as shown in FIG. 13, the middle mold segments **46*a* and 46*b* are removed, exposing the middle of the expanded tube 40. The sealing strip 24 is then applied around the exterior of the tube in the area left exposed by the removal of the middle mold segments 46a and 46b. As previously described, the sealing strip 24 may be a strip or band of resilient plastic material held in place by a suitable adhesive, or it may be a cellulose band that is applied by shrink-fitting. In either case, the sealing strip is applied with sufficient tightness to constrict the tube wall against the exterior surface of the balloon 20, thereby sealingly closing the passage 22 and creating a fluid-tight seal between the interior tube wall and the exterior balloon surface. The barrier thus created by the balloon 20 and the interior tube wall divides the tube 40 into the distal chamber 26 and the proximal chamber 28**, as previously described.

Figure 14:
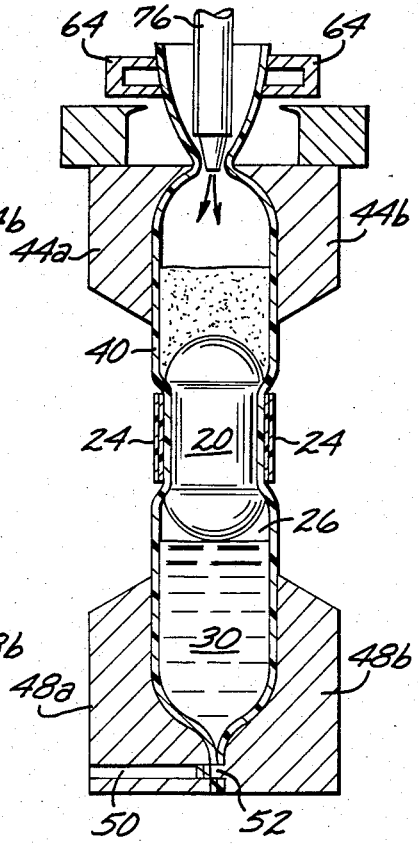
Figure 15:
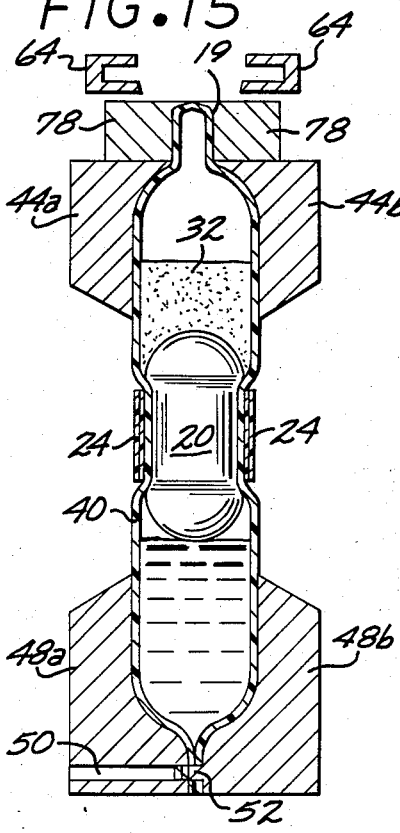

After the sealing strip 24 is applied, the divided tube 40, still in the mold, is stationed under a second metering nozzle 76, as shown in FIG. 14. The second metering nozzle 76 is inserted into the open proximal end of the tube 40, and the proximal chamber is partially filled from the nozzle 66 with a pre-measured amount of the second material 32, of the type previously described.

When the proximal chamber 28 is filled with the desired amount of the second material 32, the second metering nozzle 76 is withdrawn. At this stage, the nipple 19 at the proximal end of the tube 40 is formed and sealed by the means shown in FIG. 15. The nipple-forming means comprises a radially-movable circumferential sealing mold 78 that is disposed on or near the top surface of the upper mold segments 44a and 44b. The sealing mold 78 moves radially-inwardly while the proximal tube end is heat-softened (by conventional means), so that when the sealing mold 78 closes in its radially-innermost position, the sealed nipple 19 is formed.

Figure 16:
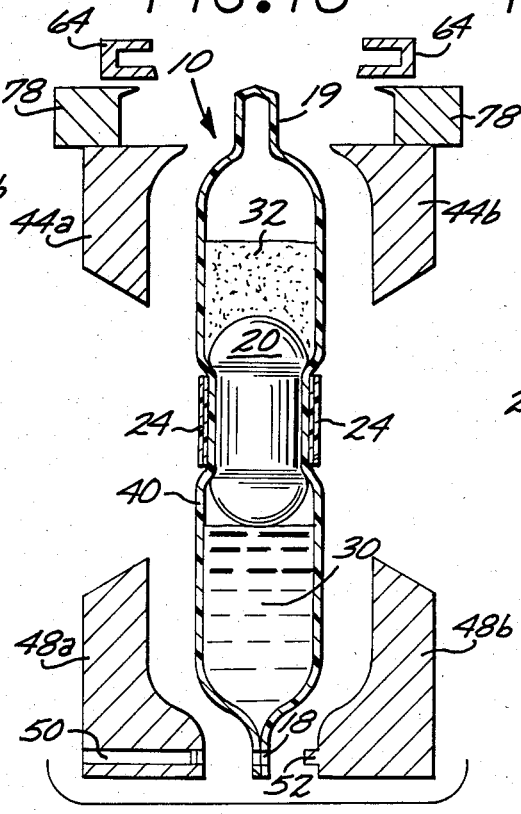
Figure 17:
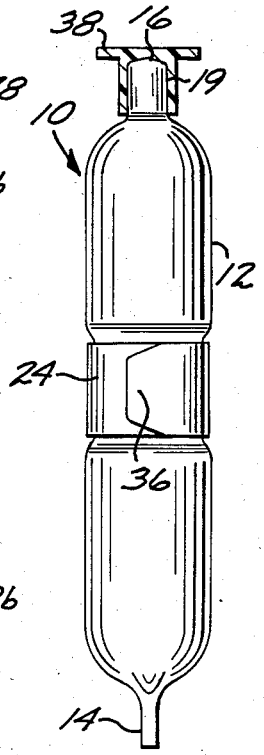
FIG. 17 is an elevational view of a finished container made by the method shown in FIGS. 6 through 16.

Finally, as shown in FIGS. 16 and 17, the finished container 10 is removed from the mold, and the protective end cap 38 is installed on the nipple 19.

From the foregoing description, it will be apparent that the present invention provides a number of significant advantages For example, the seal or barrier between the two chambers is removed without fracturing or rupturing any structure within the container. Thus, potential harm from fragments of such structure is avoided. Moreover, the opening procedure (i.e., removal of the sealing strip), being a gentle, non-destructive action, minimizes the possibility of damage to the container. Thus, containers made in accordance with the present invention are easier to use than prior art devices. In addition, the strength of the inter-chamber barrier in the present invention does not depend, in any substantial part, upon the physical characteristics of the materials used, since the barrier is formed by an intimate, surface-to-surface contact rather than a mechanical connection or attachment. Thus, the physical characteristics of these materials need not be as precisely controlled as in many prior art devices. This feature, and the invention's relative simplicity of construction, make the present invention relatively economical to manufacture. Yet, despite the invention's relative simplicity, good seal integrity can be provided with the invention's design.

Although a preferred embodiment of the invention has been described herein, it will be appreciated that a number of variations will suggest themselves to those skilled in the pertinent arts, in addition to those variations previously mentioned. For example, the container can easily be provided with three or more isolated chambers by providing two or more bubbles and sealing strips. Thus, for example, a three-chamber container can be provided with an empty middle or "buffer" chamber that can be used to enhance the mixing action and to provide a redundant barrier between the two chambers that hold the materials to be mixed. Alternatively, each of the three chambers can be filled with a separate material. Also, the thermoplastic materials mentioned above for the receptacle 12 and the bubble 20 are exemplary only. Other materials will be found that are suitable for use in a variety of applications, wherein the container materials are chemically inert in the presence of the substances used to fill the chambers. The manufacturing process disclosed herein can be readily modified to accommodate these variations and modifications in the structure of the container. These and other modifications should be considered within the spirit and scope of the invention, as defined in the claims which follow.

What is claimed is:

1. A flexible container, comprising:

an elongate receptacle of resilient material having a sealable proximal end and a sealed distal end;

a hollow member disposed in said receptacle between said proximal and distal ends; and removable sealing means for providing an openable barrier between the exterior surface of said hollow member and the interior surface of said receptacle, such that said receptacle is sealingly divided into a proximal chamber between said hollow member and said proximal end of said receptacle, and a distal chamber between said hollow member and said distal end of said receptacle, whereby the removal of said sealing means opens said barrier to allow communication between said proximal and distal chambers, thereby allowing a first material contained in said distal chamber to mix with a second material contained in said proximal chamber.

2. The container of claim 1, wherein said sealing means comprises a strip of flexible material removably applied around the exterior surface of said receptacle with sufficient tightness to create a fluid-tight barrier between the exterior surface of said hollow member and the interior surface of said receptacle.

3. The container of claim 1, wherein said hollow member comprises an inflated balloon having an inflated circumference which is smaller than the internal circumference of said receptacle, so that the removal of said sealing means creates a passage between the exterior surface of said balloon and the interior surface of said receptacle.

4. The container of claim 2, wherein said strip of flexible material is adhesively attached to the exterior surface of said receptacle by a layer of adhesive material.

5. The container of claim 2, wherein said strip of flexible material is a shrink-fit cellulose band.

6. The container of claim 1, wherein said receptacle and said hollow member are formed of a thermoplastic material selected from the group consisting of polyvinyl chloride, polyurethane, polyethylene, and styrene ethylene-butylene styrene.

7. A flexible container for separately storing first and second materials and selectively allowing said first and second materials to be intermixed, said container comprising:

an elongate, hollow receptacle having a closed proximal end, and a closed distal end, with an interior surface and an exterior surface extending between said proximal and distal ends;

a hollow member disposed in said receptacle between said proximal and distal ends, said hollow member having an external circumference which is smaller than the internal circumference of said receptacle; and removable sealing means for providing an openable, fluid-tight seal between the exterior surface of said hollow member and the interior surface of said receptacle, said seal thereby dividing said receptacle into a distal chamber containing a first material and a proximal chamber containing a second material, whereby the removal of said sealing means opens said seal to provide a passage between said proximal and distal chambers, so that said first and second materials can become intermixed.

8. The container of claim 7, wherein said passage is defined between the exterior surface of said hollow member and the interior surface of said receptacle.

9. The container of claim 7, wherein said sealing means is removably attached to the exterior surface of said receptacle.

10. The container of claim 7, wherein said hollow member comprises an inflated balloon of resilient material.

11. The container of claim 9, wherein said sealing means comprises a strip of flexible material removably applied around the exterior surface of said receptacle with sufficient tightness to create said seal.

12. The container of claim 7, wherein said first material is a liquid and said second material is a particulate material that is soluble in said first material.

13. The container of claim 7, wherein said first and second materials are liquids that are mixable with each other.

14. The container of claim 11, wherein said sealing means further comprises means for adhesively attaching said strip to said receptacle.

15. A method of making a container for separately storing first and second materials and selectively allowing said first and second materials to be intermixed, said method comprising the steps of:

(a) providing a tube of resiliently-deformable material, said tube having a proximal end and a distal end;

(b) sealing said distal end of said tube;

(c) expanding said tube to a predetermined shape;

(d) partially filling said expanded tube with a first material, said first material being contained near said distal end of said tube;

(e) inserting an uninflated balloon into said expanded tube through said proximal end;

(f) inflating said balloon to a predetermined size, wherein the exterior circumference of said balloon is less than the internal circumference of said expanded tube, so that a passage exists between the exterior surface of said balloon and the interior surface of said inflated tube;

(g) applying a removable sealing member around the exterior surface of said expanded tube with sufficient tightness to sealingly close said passage, thereby creating a substantially fluid-tight seal between the exterior surface of said balloon and the interior surface of said expanded tube;

(h) filling at least a portion of said expanded tube between said balloon and said proximal end with a second material; and (i) sealing said proximal end of said tube.

16. The method of claim 15, wherein said tube is made of a thermoplastic material, and wherein said step of providing said tube comprises the steps of:

(a) continuously extruding said thermoplastic material into a tubular shape; and (b) cutting said tubular shape to a predetermined length.

17. The method of claim 15, wherein said tube is made of a thermoplastic material, and wherein said step of expanding said tube comprises the steps of:

(a) injecting a gas into the proximal end of said tube while said thermoplastic material is in a heat-softened state until said tube has expanded to said predetermined shape; and (b) venting said gas from said tube through the proximal end thereof.

18. The method of claim 17, wherein said predetermined shape is defined by a mold surface surrounding said tube.

19. The method of claim 15, wherein said step of inflating said balloon comprises the steps of:

(a) providing an uninflated balloon made of an inflatable plastic material;

(b) inserting said uninflated balloon into said tube at the end of a hollow conduit;

(c) flowing gas into said conduit with sufficient pressure to inflate said balloon to said predetermined shape; and (d) removing said conduit from said balloon and from said tube, whereby said inflatable, plastic material self-seals the entry point of said conduit to maintain the inflation of said balloon.

20. The method of claim 15, wherein said sealing member comprises a band of heat-shrinkable material, and wherein said step of applying said removable sealing member comprises the step of applying said band in a manner that permits the manual removal of said band when the mixing of said first and second materials is desired.

* * * * *